US005077883A

United States Patent [19]

Schellekens et al.

[11] Patent Number: 5,077,883

[45] Date of Patent: Jan. 7, 1992

[54] PROCESS FOR FIXING A METAL SCREEN IN THE HOUSING OF A VACUUM SWITCH

[75] Inventors: Hans Schellekens, Enschede; Klaas Lenstra, Hengelo; Jonannes H. L. A. Hilderink, Haaksbergen; Johan H. J. Ter Hennepe, Borne, all of Netherlands

[73] Assignee: Holec Systemen en Componenten B.V., AA Hengelo, Netherlands

[21] Appl. No.: 549,076

[22] Filed: Jul. 6, 1990

[30] Foreign Application Priority Data

Jul. 7, 1989 [NL] Netherlands ..... 8901748

[51] Int. Cl.[5] ..... B21D 3/16

[52] U.S. Cl. ..... 29/402.19; 29/507; 29/522.1; 29/523

[58] Field of Search ..... 29/402.05, 402.19, 507, 29/523, 522.1

[56] References Cited

U.S. PATENT DOCUMENTS

| | | | |
|---|---|---|---|
| 2,980,782 | 4/1961 | Schneider | 200/144 |
| 3,590,185 | 6/1971 | Pflanz | 200/144 |
| 4,320,568 | 3/1982 | Herrod et al. | 29/507 X |
| 4,418,457 | 12/1983 | Mueller | 29/523 X |
| 4,508,321 | 4/1985 | Morimoto | 29/523 X |
| 4,887,853 | 12/1989 | Flowers et al. | 29/523 X |

FOREIGN PATENT DOCUMENTS

| | | | |
|---|---|---|---|
| 286335 | 10/1988 | European Pat. Off. . | |
| 2233787 | 1/1974 | Fed. Rep. of Germany . | |
| 8334848 | 12/1988 | Fed. Rep. of Germany . | |
| 0611732 | 2/1960 | Italy | 29/507 |
| 61-176021 | 8/1986 | Japan . | |
| 1314397 | 5/1987 | U.S.S.R. . | |

*Primary Examiner*—Timothy V. Eley
*Assistant Examiner*—C. Richard Martin
*Attorney, Agent, or Firm*—Watson, Cole, Grindle & Watson

[57] ABSTRACT

In the process of fixing a metal screen in the housing of a vacuum switch, the screen is plastically deformed radially outwards over an internal supporting edge in the housing. The plastic deformation of the screen is carried out at an edge thereof, in such a way that an outward flanged edge is formed. Thus, the screen is retained on the supporting edge by that flanged edge and a part of the housing with a relatively large diameter. Therefore, the screen has a part with a relatively small diameter which is essentially equal to the internal diameter of the supporting edge of the housing.

8 Claims, 2 Drawing Sheets

PROCESS FOR FIXING A METAL SCREEN IN THE HOUSING OF A VACUUM SWITCH

FIELD OF THE INVENTION

The present invention relates to a process for fixing a metal screen in the housing of a vacuum switch, in which the inside wall of the housing has a radially running supporting part to support the metal screen, and the metal screen is inserted axially into the housing until it is past the supporting part and is then plastically deformed radially outwards over the periphery in such a way that the screen with the plastically radially outward deformed parts is retained relative to the supporting part.

DESCRIPTION OF THE PRIOR ART

Such a process is generally known. Examples thereof can be found, inter alia, in SU-A-1314397 and JP-A-61/176021. According to this known process, the screen is plastically deformed outwards near the supporting part. In this process very high tensions and deformations occur locally and can give rise to cracks. This is undesirable, since such cracking weakens the fastening between housing and screen. Cracks also weaken the screening effect. On account of the concealed position of the fastening point, in the interior of housing and screen, it is also not readily possible to check the quality of the fastening.

For carrying out the fixing operation it is necessary to have a complicated tool which has to be capable of expansion at the fastening area. It is very important in this case for the expanding parts of said tool to be positioned in the correct manner, so that only those parts of the screen which can ensure the connection to the housing are plastically deformed outwards. In this respect also, subsequent checking is not readily possible, given the concealed position of the fastening place.

SUMMARY OF THE INVENTION

The object of the invention is therefore to produce a process of the type mentioned in the preamble by which the screen can be fixed in the housing in a simpler, but more reliable manner which is easier to check. This object is achieved according to the invention in that the metal screen is provided with a first generally cylindrical section and a second generally cylindrical section having a diameter which is smaller than the diameter of the first generally cylindrical section. A third section, which is generally cylindrical and tapered, is located between the first and second sections and connects them. After inserting said second section of the screen into the housing, said third section is abutting the supporting part of the housing. Thus, the screen is supported in an axial direction. Subsequently, the edge area of the second section of the screen is deformed radially outwardly in such a way that an outward flanged edge is formed which captures the supporting part of the housing between the outwardly flanged edge and the third section.

In the case of the process according to the invention the edge of the screen is flanged, so that the screen is given a widened end which is still easy to inspect from the outside. In addition, for the flanging of such an edge lower forces are necessary than for deforming a central part of the housing outwards. The result of these simplifications is that the manufacturing operations are simpler and cheaper.

It is known for a housing with an inward-projecting supporting part to use a screen which has a part with relatively small diameter and also a part with relatively large diameter. In the case of such a screen provision is made for the part with relatively small diameter to be inserted until it is past the supporting part, in such a way that the part with relatively large diameter connecting thereto in the direction of insertion comes to rest against the supporting part, following which the radially projecting edge of the screen is flanged. The screen thus fixed is now held in place on the supporting part of the housing between the part with larger diameter and the flanged edge.

If according to a variant the housing has two inward-projecting supporting parts situated in the axial direction at a distance from each other, the process according to the invention provides a screen with one outwardly flanged edge which screen has such a length that after insertion thereof an axially projecting edge is obtained at the sides of the supporting parts facing away from each other, and the edge of the screen opposite the already flanged edge is deformed radially outward.

The process is preferably carried out with the aid of a tool with a conical surface, of which the smallest diameter is at the front side and is smaller than the internal diameter of the unflanged edge, while the tool is pressed axially against the edge, and the screen is retained against the pressure force in such a way that a corresponding conically flanged edge is obtained. An edge which is flanged conically in this way still provides a certain screening effect if it forms an angle of between 30° and 70° relative to a radial plane.

The tool used according to the process has no expansion parts, which means that the cost thereof can be kept low.

The invention also relates to a screen which can be used in the above-mentioned process. If such a screen is designed in such a way that the relatively small diameter is essentially equal to the internal diameter of the supporting part in the housing, only one edge need be flanged to fix said screen in the housing, which facilitates the manufacture. The screen is in this case designed in such a way that the length along the part with relatively small diameter is equal to the sum of the axial lengths of the supporting part and the unflanged edge.

Finally, the invention relates to a vacuum switch manufactured according to the above-described process. Such a vacuum switch is advantageously so designed that the contact poles of the switch touch each other in the part of the screen with the relatively large diameter. If the free edge of the screen tapers conically in the known manner, the screening action of the screen is improved even further.

BRIEF DESCRIPTION OF THE DRAWINGS

The invention will be explained in greater detail below with reference to the drawings, wherein.

Figure 1:
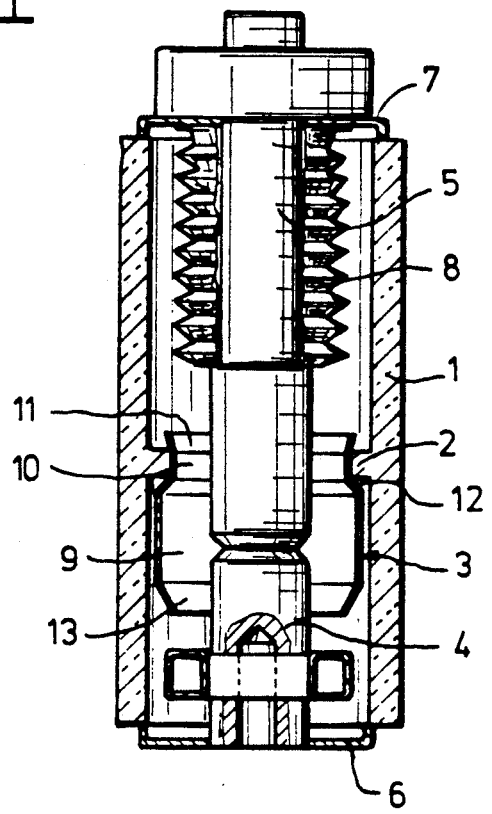
FIG. 1 shows schematically a vacuum switch containing a screen fixed therein according to the invention.

The vacuum switch shown in FIG. 1 is composed in the known manner of a housing 1 of insulating material which is provided on the inside with an annular part 2 on which the screen 3 is fixed. Located in the housing in a known manner are a fixed contact 4 and a moving contact 5. By means of the end ring 6 and the end ring 7 and the bellows 8 respectively, the contacts 4 and 5 are fixed in a sealing manner to the housing 1, so that a vacuum can be maintained in the interior thereof.

As is known, the screen fitted around the contacts prevents the housing 1 from being contaminated by any metal vapour which occurs during the breaking of the connection between the contacts.

As shown in FIG. 1, the screen 3 comprises a part 9 with relatively large diameter and a part 10 with relatively small diameter. The external diameter of the part 10 is approximately equal to the internal diameter of the supporting ring 2, in such a way that the screen 3 fits into it virtually without play. The edge 11 of the screen projecting from the supporting guide 2 is flanged widening outwards conically, in such a way that the screen 3 is held firmly in the housing between said edge 11 and the transition part 12. The edge 11 is not flanged completely through 90° to the supporting guide 2, so that it still provides a certain screening effect. Finally, the free end of the screen 3 is flanged inwards at an angle in a known manner, in order to form an edge 13 which is also conical, and the purpose of which is to improve the screening effect in this part of the housing.

Figure 2:
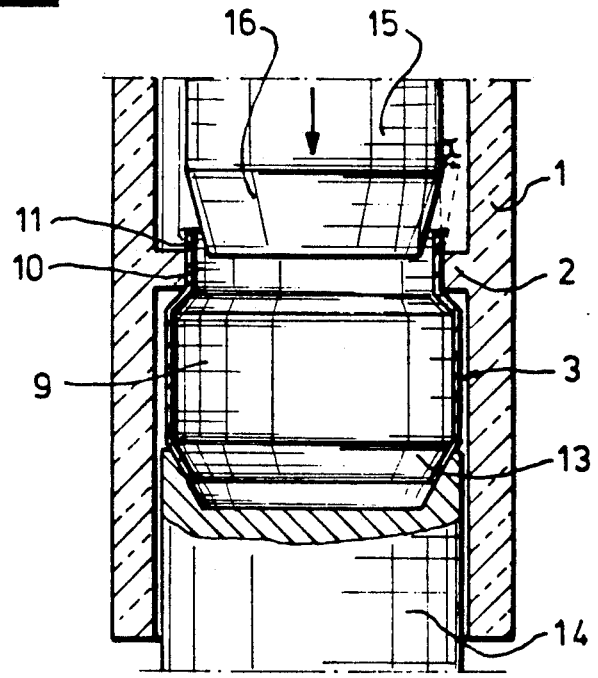
FIG. 2 shows a phase of the process according to the invention.

FIG. 2 shows a phase of fixing of the screen 3 in the housing 1. As shown, the edge 11 in this case still runs in line with the part 10 with relatively small diameter, so that the screen 3 can be inserted into the supporting part 2. A correspondingly shaped retaining element 14 is then held pressed onto the conical edge part 13, following which the mandrel 15 is moved towards the edge part 11 in the direction of the arrow. When the mandrel 15 is moved further it presses the edge part outwards plastically according to the conical shape of its front part 16. This produces the conically widened part 11 shown in FIG. 1. The size of the half apex angle of the imaginary cone coinciding with the flanged edge 11 is preferably equal to a value between 30° and 70°. With such an angle size the flanged edge 11 still provides a certain screening effect with respect to the housing 1.

The length of the flanged edge 11 is preferably $\frac{1}{3}$ to $\frac{2}{3}$ the length of the screen resting within the supporting part in an axial direction.

Figure 3:
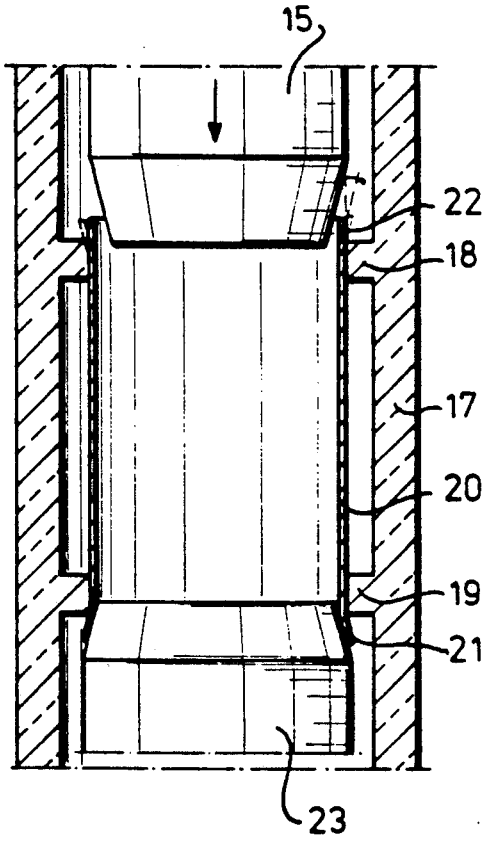
FIG. 3 shows a vacuum switch according to a second embodiment of the screen.

FIG. 3 shows a vacuum switch provided with a housing 17 containing two axially spaced, annular supporting parts 18, 19. The screen 20 is cylindrical, and at one end initially has a wide part 21. After insertion of the screen 20, such that part 21 abuts supporting part 19, the other end 22 of screen 20 is plastically pressed outwardly by means of tool 15.

We claim:

1. A process for fixing a metal screen in the housing of a vacuum switch, wherein the metal screen comprises a first generally cylindrical section, a second generally cylindrical section having a smaller diameter then the first generally cylindrical section, and a third generally cylindrical tapered section connecting said first and second sections together, and wherein said housing is of a cylindrical shape and comprises a radially inwardly projecting supporting part having an inner diameter which is smaller than an inner diameter of said housing, said inner diameter of said supporting part being substantially the same as the outer diameter of said second section of said screen, said process comprising:

inserting said screen into said housing such that said second section of said screen passes through said supporting part until said third generally tapered section comes to rest against said supporting part;

radially deforming said second section to form a flanged edge having a diameter greater than said supporting part such that said screen is held within said housing by the contact of said third generally tapered section and said flanged edge of said second section with said supporting part of said housing.

2. A process according to claim 1, wherein said radially deforming outwardly is preformed by a tool with a conical surface which comes into contact with said second section of said screen, said conical surface having a working surface at its end which contacts said screen and which is of a smaller diameter than the internal diameter of the second section of said screen, said process further comprising retaining said screen against said supporting part by forcing said first generally cylindrical section in an axial direction such that said third tapered section is forced against said supporting part and held there while said radially outward deformation occurs.

3. A process as defined in claim 2, wherein the flanged edge is flanged through an angle between 30° and 70° relative to a radial plane defined by said supporting part.

4. A process as defined in claim 3, wherein the length of the flanged edge is $\frac{1}{3}$ to $\frac{2}{3}$ the length of the second section of said screen resting within said supporting part in an axial direction.

5. A process as defined in claim 1, wherein said first generally cylindrical section includes a radially inwardly deformed end opposite the end connected to the third tapered section.

6. A process for fixing a metal screen in a housing of a vacuum switch, said metal screen being of a cylindrical shape and having two ends, one of which is flanged, and an inner and outer diameter, said housing being of cylindrical shape and having two inwardly projecting supporting parts situated at a distance from each other in an axial direction, said supporting parts having the same inner diameter as each other which diameter is greater than the outer diameter of said screen, said screen having a length greater than the length defined between the two supporting parts in an axial direction, said process comprising:

inserting said screen into said housing and through said supporting parts such that the screen rests in the two supporting parts and the two supporting parts are between the two ends of said screen;

supporting said flanged end of said screen within said housing;

radially deforming outwardly an end of said screen opposite the flanged end to form a flanged edge having an outer diameter greater than the inner diameter of the supporting parts.

7. A process as defined in claim 6, wherein said outer radial deformation is performed by a tool with a conical surface, the conical surface having a diameter at its end which is smaller than the inner diameter of the ends of said screen before the ends are flanged.

8. A process according to claim 6, wherein said flanged edges are flanged through an angle between 30° and 70° relative to a radial plane defined by the inner diameter of said supporting parts.

* * * * *